US009134006B2

(12) United States Patent
Rodgers et al.

(10) Patent No.: US 9,134,006 B2
(45) Date of Patent: Sep. 15, 2015

(54) BEAM SHAPING LENS AND LED LIGHTING SYSTEM USING SAME

(71) Applicant: Cree, Inc., Durham, NC (US)

(72) Inventors: Elizabeth Rodgers, Raleigh, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/657,421

(22) Filed: Oct. 22, 2012

(65) Prior Publication Data

US 2014/0111984 A1 Apr. 24, 2014

(51) Int. Cl.

| | |
|---|---|
| ***F21V 5/04*** | (2006.01) |
| ***F21V 5/00*** | (2015.01) |
| *F21K 99/00* | (2010.01) |
| *F21S 8/02* | (2006.01) |
| *F21V 17/16* | (2006.01) |
| *F21Y 101/02* | (2006.01) |
| *F21Y 105/00* | (2006.01) |

(52) U.S. Cl.

CPC . *F21V 5/04* (2013.01); *F21V 5/005* (2013.01); *F21K 9/54* (2013.01); *F21S 8/026* (2013.01); *F21V 17/164* (2013.01); *F21Y 2101/02* (2013.01); *F21Y 2105/001* (2013.01)

(58) Field of Classification Search

CPC ..... F21K 9/54; H05B 33/0833
USPC ..... 362/231, 244, 362; 313/113, 493
See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

OTHER PUBLICATIONS

Arthur Davis et al., "Optical Design using Fresnel Lenses," Optik & Photonik, Dec. 2007, No. 4, pp. 52-55.

*Primary Examiner* — Mary Ellen Bowman
(74) *Attorney, Agent, or Firm* — Steven B. Phillips; Moore & Van Allen, PLLC

(57) ABSTRACT

A beam shaping lens and an LED lighting system are disclosed. The lens according to example embodiments can concentrate or spread light, depending on the specific embodiment used. The lens according to example embodiments of the invention includes repeated concentric rings of refractive features, with either a constant or gradient feature angle. These features may include substantially triangular concentric rings. These features are located on the interior face of the lens, facing the LED source. In some embodiments, the exterior or exit surface of the lens includes texturing. A lens according to example embodiments of the invention can be used with various fixtures. Light enters the lens through the entry surface including the concentric rings, and exits the fixture through a textured exit surface opposite the entry surface.

32 Claims, 10 Drawing Sheets

(56) References Cited

U.S. PATENT DOCUMENTS

| | | | | |
|---|---|---|---|---|
| 5,947,588 | A | 9/1999 | Huang | |
| 5,949,347 | A | 9/1999 | Wu | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,429,581 | B1 * | 8/2002 | Trentelman | 313/493 |
| 6,465,961 | B1 | 10/2002 | Cao | |
| 6,523,978 | B1 | 2/2003 | Huang | |
| 6,550,953 | B1 | 4/2003 | Takahashi et al. | |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,213,940 | B1 | 5/2007 | Van De Ven et al. | |
| 7,354,174 | B1 | 4/2008 | Yan | |
| 7,396,142 | B2 | 7/2008 | Laizure, Jr. et al. | |
| 7,600,882 | B1 | 10/2009 | Morejon et al. | |
| 7,726,836 | B2 | 6/2010 | Chen | |
| 7,824,065 | B2 | 11/2010 | Maxik | |
| 8,021,025 | B2 | 9/2011 | Lee | |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,449,154 | B2 | 5/2013 | Uemoto et al. | |
| 8,502,468 | B2 | 8/2013 | Li et al. | |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2004/0201990 | A1 | 10/2004 | Meyer | |
| 2005/0243551 | A1 * | 11/2005 | Onishi et al. | 362/244 |
| 2009/0184618 | A1 | 7/2009 | Hakata et al. | |
| 2010/0123600 | A1 * | 5/2010 | Mayer et al. | 340/907 |
| 2012/0040585 | A1 | 2/2012 | Huang | |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

* cited by examiner

BEAM SHAPING LENS AND LED LIGHTING SYSTEM USING SAME

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in multicolor arrays that can be controlled to deliver virtually any color light, and contain no lead or mercury.

In many applications, one or more LED dies (or chips) are mounted within an LED package or an LED module, which may make up part of a lighting fixture which includes one or more power supplies to power the LEDs. Some lighting fixtures include multiple LED modules. A module or strip of a fixture includes a packaging material with metal leads (to the LED dies from outside circuits), a protective housing, and/or a combination of leads, housing and heat sink.

An LED fixture may be made with a form factor that allows it to replace a standard incandescent fixture or bulb, or any of various types of fluorescent or halogen lamps. LED fixtures and lamps often include some type of optical elements external to the LED modules themselves. Such optical elements may allow for diffusion, localized mixing of colors, collimate light, provide a controlled beam angle and/or provide beam shaping. Optical elements may include reflectors and/or, lenses. Lenses may be of glass or plastic and as examples may take the form of lens plates, total internal reflection (TIR) elements, or more traditional circular, concave or convex lenses.

SUMMARY

Embodiments of the present invention can provide for beam shaping of light from a distributed LED source in a lighting system. The lens according to example embodiments can concentrate light, or spread light over the face of the lens depending on the specific embodiment used. The lens according to some embodiments can also obscure the pixelated nature of the source, eliminating pixilation or color separation. A lens according to example embodiments of the invention includes repeated concentric rings of refractive features, which may have either a constant or gradient feature angle. These features are located on the interior face or entry surface of the lens, facing the LED source. In some embodiments, the exterior face or exit surface of the lens also includes texturing. A lens according to example embodiments of the invention can be used with various fixtures. As examples, the lens can easily be adapted to various shapes and sizes of down-shining fixtures designed to be installed in a ceiling and can be used with both indoor and outdoor lighting.

A lens for a lighting system according to example embodiments of the invention has an entry surface including a plurality of concentric rings having non-vertical sides. In some embodiments, the rings are substantially triangular. In some embodiments, the rings are spaced at an interval between 0.1 and 5 mm. In some embodiments, the rings are spaced at an interval between 0.2 and 3 mm. In some embodiments, the rings are spaced at an interval between 0.3 and 2 mm. In some embodiments, the rings are spaced at an interval of about 0.5 mm. In some embodiments, the lens includes a textured exit surface.

In some embodiments of the invention, substantially triangular concentric rings have a vertex angle of from about 35 degrees to about 90 degrees. In some embodiments, the substantially triangular concentric rings have a vertex angle of from about 40 degrees to about 65 degrees. In some embodiments, the vertex angle is substantially the same for each of the substantially triangular concentric rings, and in some embodiments, a gradient is applied to the vertex angle of the substantially triangular concentric rings so that the vertex angle varies across a radius of the lens. In some embodiments, the spacing interval of the substantially triangular concentric rings can also vary across the radius of the lens.

In some embodiments, a lens as described above is used in a lighting system or fixture that includes an LED light source and a proximate reflector. The lens is disposed to receive the light from the LED light source whether directly or as reflected by the reflector and may be attached to the reflector, either directly or indirectly. The light enters the lens through the entry surface including the concentric rings and exits the fixture through an exit surface opposite the entry surface. The exit surface may be textured. A power supply can be provided to energize LEDs in the LED light source, which can be connected to the power supply via wires and/or traces in or on a substrate or circuit board, that together with the LEDs, form an LED assembly.

In some embodiments, a fixture with the lens may use LEDs that emit different colors of light. A phosphor that emits light of a specific color may also be used. For example, the LED light source may include at least first and second LEDs which, when illuminated, emit light having a dominant wavelength from 435 to 490 nm and a dominant wavelength from 600 to 640 nm, respectively, and a phosphor which, when excited, emits light having a dominant wavelength from 540 to 585 nm. The lens in such an embodiment can eliminate color separation that might otherwise be observable in such a fixture.

DETAILED DESCRIPTION

Figure 1:
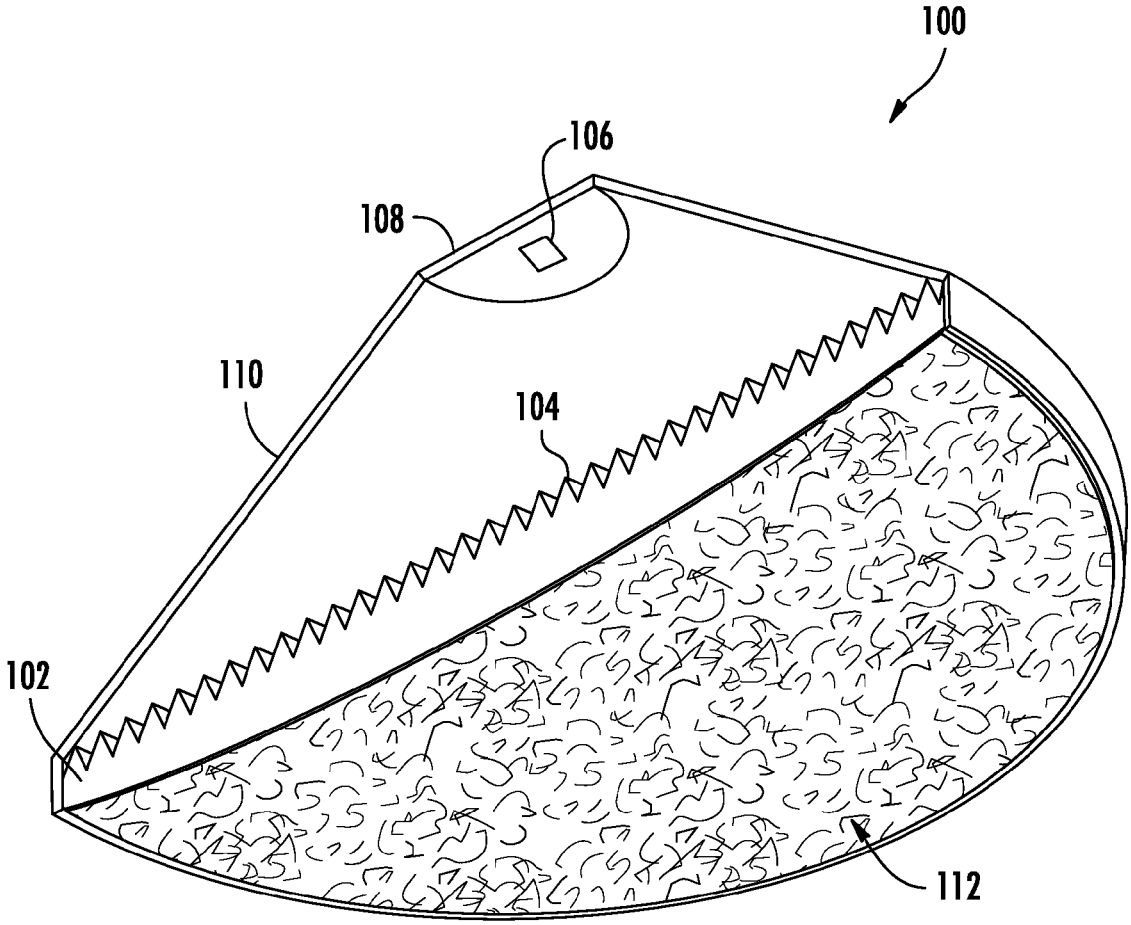
FIG. 1 is a schematic representation of a light engine for a lighting system with the beam shaping lens according to example embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Embodiments of the present invention can provide for beam shaping of light from a distributed LED source such as those making use of multiple LED chips and/or chip packages to create white light. The lens according to example embodiments can concentrate light, or spread light over the face of the lens depending on spacing and/or angle parameters for the concentric features on the entry surface of the lens. Embodiments of the invention can also be implemented in outdoor fixtures used for sign illumination or down-lighting. A lens according to example embodiments of the invention works with distributed LED light sources, such as sources with multiple and even many LEDs occupying a relatively large space inside the fixture. Such sources typically do not work well with traditional lenses such as Fresnel lenses, which are designed for a point source of light. With embodiments of the present invention, the effective surface area of the lens is increased by the space taken up by the surface of the concentric features, allowing for effective beam shaping.

FIG. 1 is a schematic illustration of light engine 100 shown in a perspective cross-sectional view. Light engine 100 of FIG. 1 includes lens 102 according to example embodiments of the invention. The entry surface of lens 102 includes a plurality of substantially triangular concentric rings 104, each having non-vertical sides. By the term "non-vertical," what is meant is that neither side of the triangle formed by the cross-section of the concentric ring is parallel to the direction in which the light exits the light engine. In this example embodiment, LED light source 106 is a device package with multiple LED chips (not shown). Light source 106 is mounted on a substrate 108 to form an LED assembly. The LED assembly is proximate to a reflector 110 in that the bottom portion of the reflector is near the LED light source. Many other arrangements of a reflector in an LED light source are possible within the scope of embodiments of the invention. For example, it would be possible to implement an embodiment of the invention in a retro-reflective design using two or more reflectors.

Still referring to FIG. 1, exit surface 112 of lens 102 includes surface texturing. This surface texturing provides additional diffusion for light exiting the light engine. This surface texture is represented in FIG. 1 schematically; however, could consist of dimpling, frosting, or any other type of texture that can be applied to a lens for a lighting system. Finally, it should be observed that exit surface 112 is slightly curved. However, embodiments of the invention can include a flat exit surface, or a curved entry service. Both surfaces of the lens could be flat or curved. Several examples will be presented herein.

A lens according to example embodiments can be made in various ways. The example of FIG. 1 is a schematic illustration. The actual numbers of concentric rings, and the actual size and spacing of the rings, are not to scale. The cross-section of the concentric features in FIG. 1 is an equilateral triangle, but other triangular shapes can be used. Additionally, the cross-section of a feature can be a more complex, irregular or faceted shape. The vertex angle of the equilateral triangles in the example of FIG. 1 is constant, as is the spacing of the concentric circular features. However, varying these properties of the lens features can allow the formation of differing beam patterns, either concentrating or spreading the light as chosen by the lens designer. Either the vertex angle of the triangles or the spacing interval of the concentric features across the diameter of the lens can change or have a gradient applied. For example, in some embodiments, the substantially triangular concentric rings can be spaced at a fixed interval from about 0.1 mm to about 5 mm across the radius of the lens. In some embodiments, they can be spaced at a fixed interval from between about 0.2 mm to about 3 mm. In some embodiments they can be spaced a fixed interval from between about 0.3 mm to about 2 mm. In some embodiments they can be spaced at a fixed interval of about 0.5 mm. A gradient can also be applied to the spacing so that the interval varies. For example, the interval can be smaller near the center of the lens and progress to a larger interval closer to the edge of the lens, or vice versa. Multiple discrete intervals can also be used, and the features could occur in bands or groups with flat, slightly curved, or relatively featureless spaces in between. Specific variations of the vertex angle for embodiments where the lens includes substantially triangular concentric rings will be discussed below with respect to FIGS. 4-9.

Figure 2:
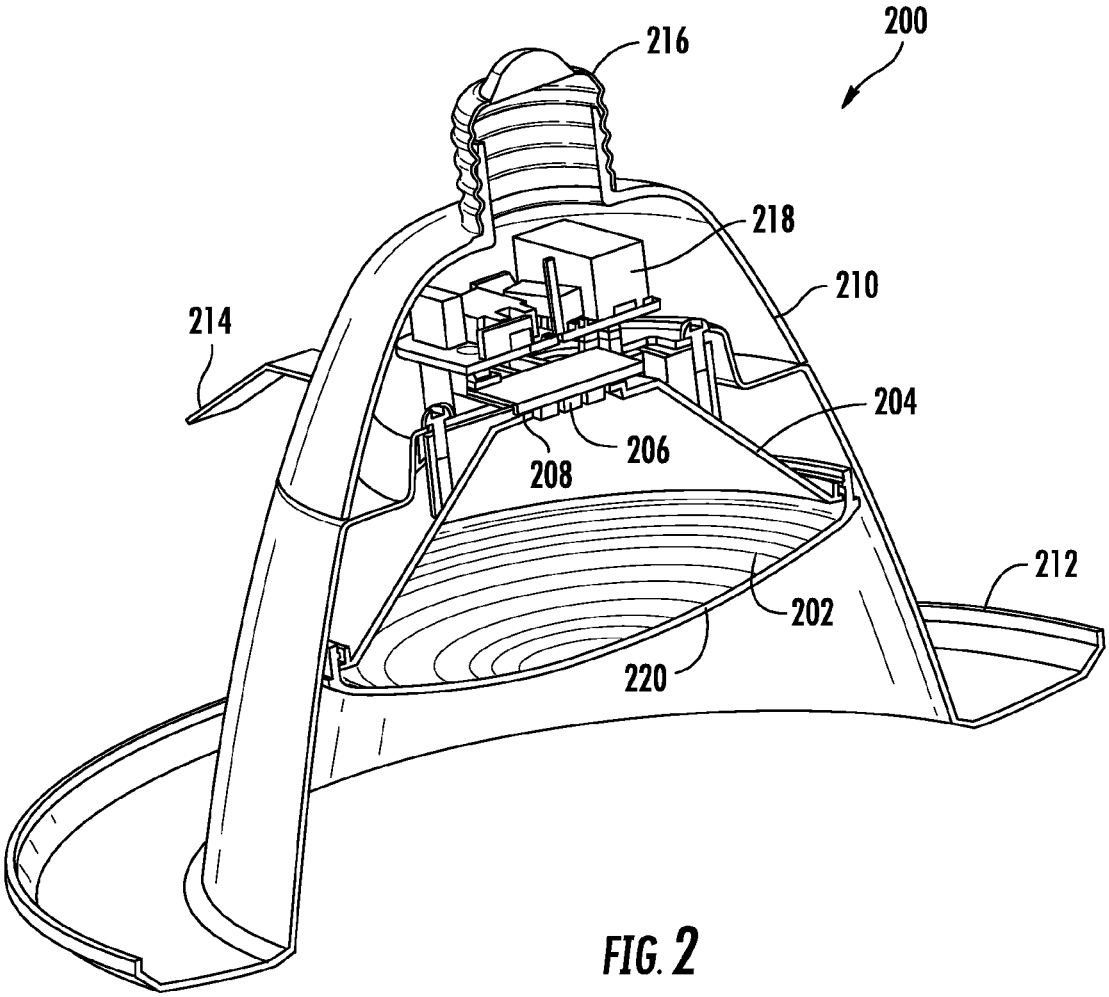
FIGS. 2 and 3 are cross sectional views of fixtures according to example embodiments of the present invention.

FIG. 2 is a cutaway perspective view of a lighting system 200, an LED fixture according to example embodiments of the invention. FIG. 2 includes lens 202 which is attached to reflector 204. An LED light source 206, including multiple LED device packages, is installed proximate to reflector 204. In the example of FIG. 2, the LEDs are mounted on a substrate 208 to form an LED assembly. Lighting system 200 has an outer case 210 and trim ring 212 that allows it to be installed inside the outer shell of a "recessed can" style fixture in place of an incandescent bulb. The fixture includes retaining clips 214 and an Edison style, screw-in plug 216 to be connected with the socket of the remaining portion of the recessed can fixture. Power supply 218 receives power through Edison plug 216 and supplies power to the LED light source 206. The LED facing or entry surface of lens 202 for lighting system 200 includes a plurality of substantially triangular concentric rings 220 as previously discussed.

Figure 3:
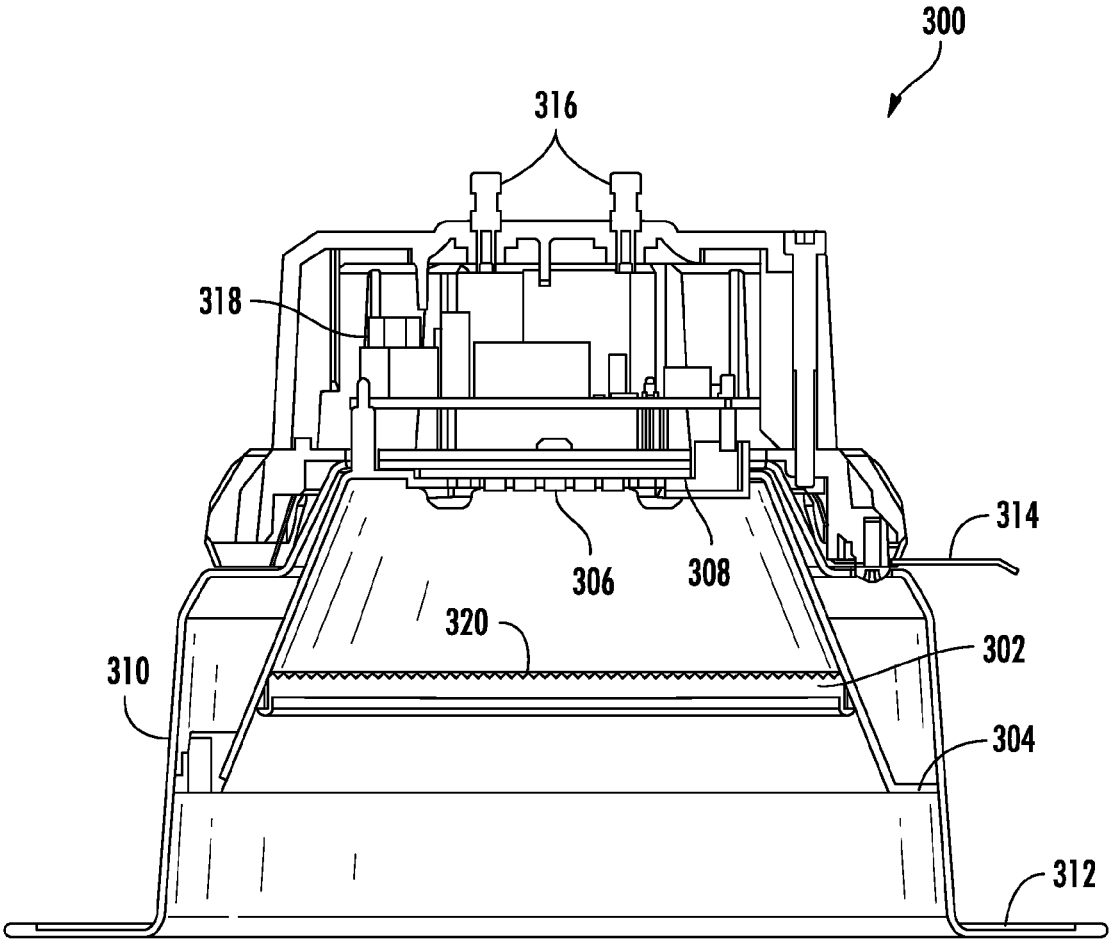

FIG. 3 is a cutaway perspective view of a light fixture 300, an LED lighting system, according to example embodiments of the invention. FIG. 3 includes lens 302 which is attached to reflector 304. An LED light source 306, including multiple LED device packages, is installed proximate to reflector 304. In the example of FIG. 3, the LEDs are mounted on a substrate 308 to form an LED assembly. Lighting system 300 has an outer case 310 and trim ring 312 that allows it to be installed in a circular void in a ceiling. The fixture includes a retaining clip 314 and connecting pins 316. Power supply 318 receives power through pins 316 and supplies power to the LED light source 306. The LED facing or entry surface of lens 302 for fixture 300 includes a plurality of substantially triangular concentric rings 320 as previously discussed.

Figure 4A:
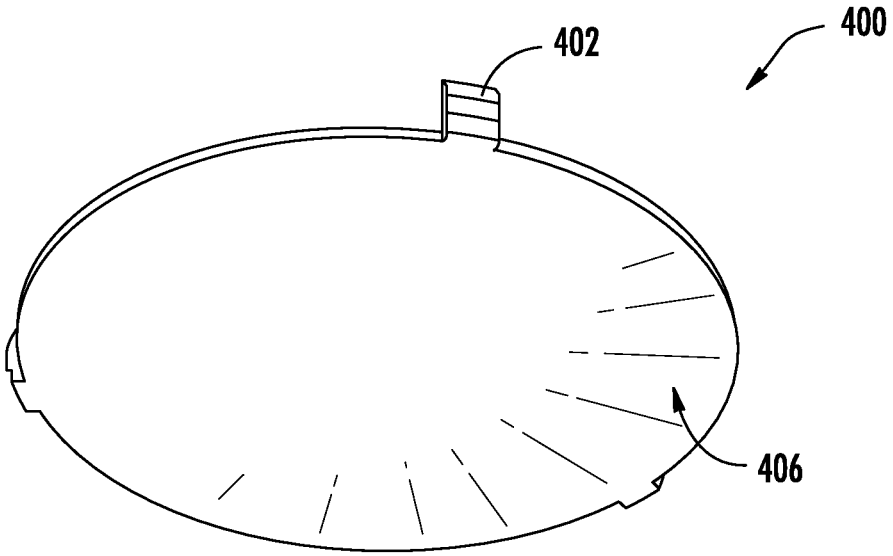
FIGS. 4A and 4B are a perspective view and a side view, respectively, of a lens according to example embodiments of the invention.
Figure 4B:
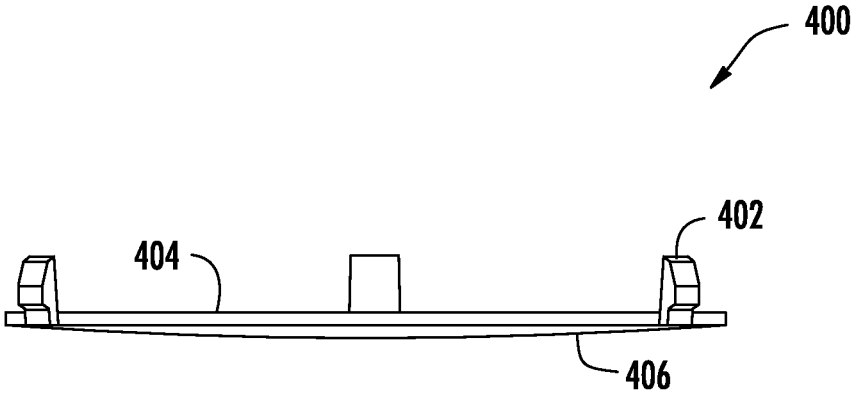
Figure 5:
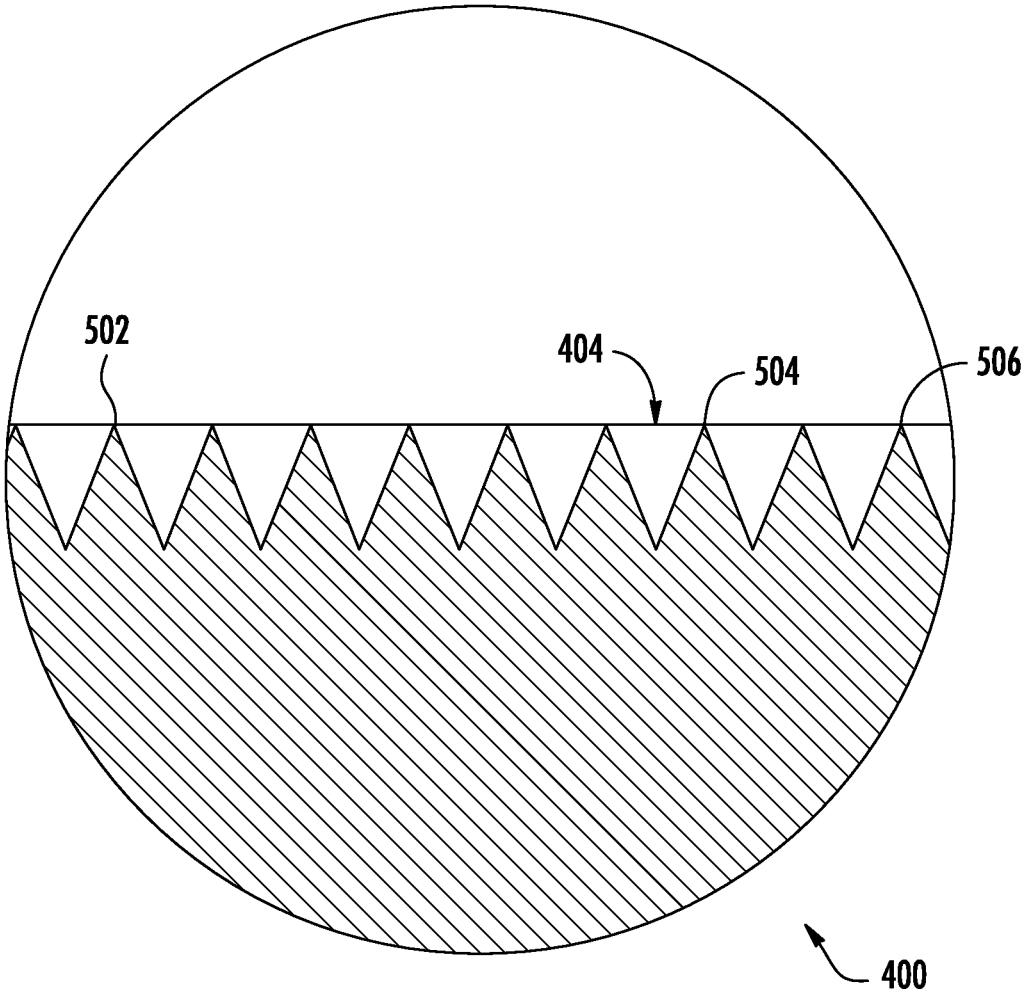
FIG. 5 is a magnified, cross-sectional view of the lens depicted in FIGS. 4A and 4B.

FIGS. 4 and 5 illustrate a more detailed example lens according to example embodiments of the present invention. Lens 400 is presented in FIG. 4 as FIG. 4A, a perspective view and FIG. 4B, a side view. Lens 400 includes a plurality of tabs 402 for engaging with other parts of a light fixture. Lens 400 is substantially flat on both its entry surface 404 and its exit surface 406. FIG. 5 shows a close-up, cross-sectional view of a portion of entry surface 404 of lens 400. Substantially triangular concentric rings are visible, spaced at an interval of 0.500 mm. As can be observed in the figure, the height of the features is 0.635 mm. As can also be observed, a gradient is applied to the vertex angle of the features. Vertex 502 has an angle of 43.0°, and the angle decreases from left to right to vertex 504 with an angle of 40.0°. All the way to the right, vertex angle 506 increases again to an angle of 40.5°.

Figure 6A:
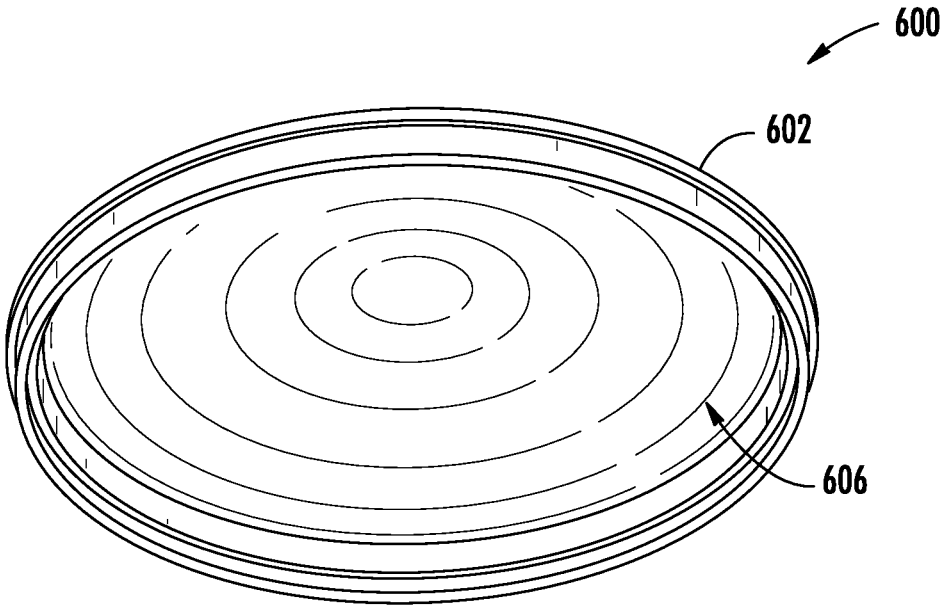
FIGS. 6A and 6B are a perspective view and a side view, respectively, of a lens according to additional example embodiments of the invention.
Figure 6B:
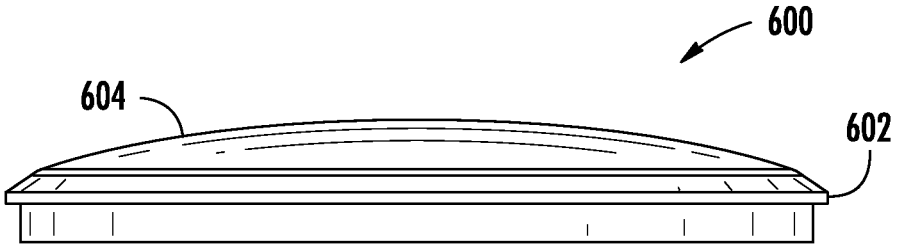
Figure 7:
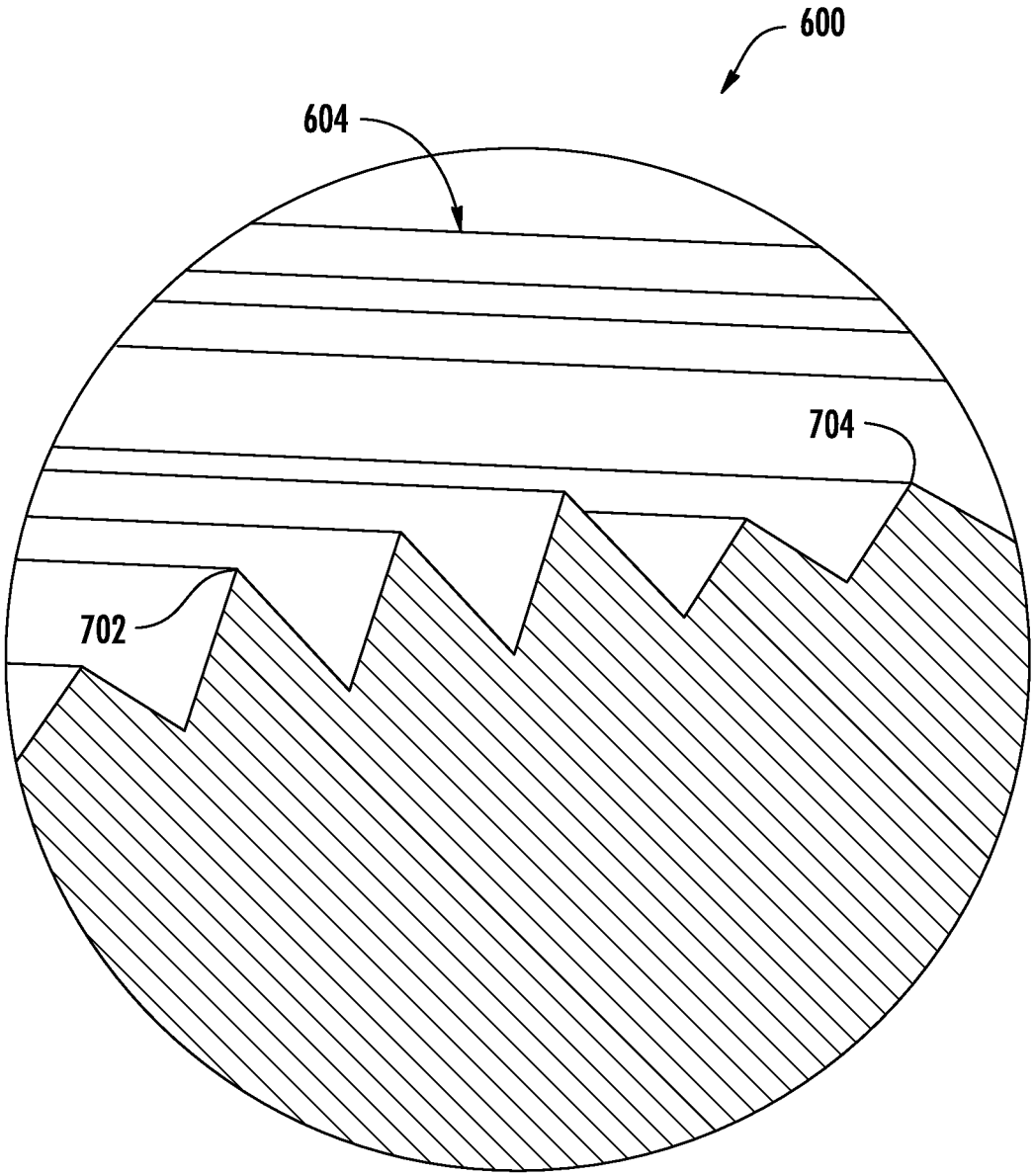
FIG. 7 is a magnified, cross-sectional view of the lens depicted in FIGS. 6A and 6B.

FIGS. 6 and 7 illustrate a detailed example lens according to other embodiments of the present invention. Lens 600 is presented in FIG. 6 as FIG. 6A, a perspective view and FIG. 6B, a side view. Lens 600 includes a ridge 602 for engaging with other parts of a light fixture. Lens 600 is curved or convex in shape on its entry surface 604 and substantially flat on its exit surface 606. FIG. 7 shows a close-up, cross-sectional view of a portion of entry surface 604 of lens 600. Substantially triangular concentric rings are visible, spaced and interval of 0.500 mm. These rings follow the curved contour of the entry or LED-facing surface of the lens. As can be observed in the figures, the vertex angle of the feature varies. Vertices 702 with a greater height have an angle of 60.0°, and vertices 704 have an angle of 90.0°.

Figure 8A:
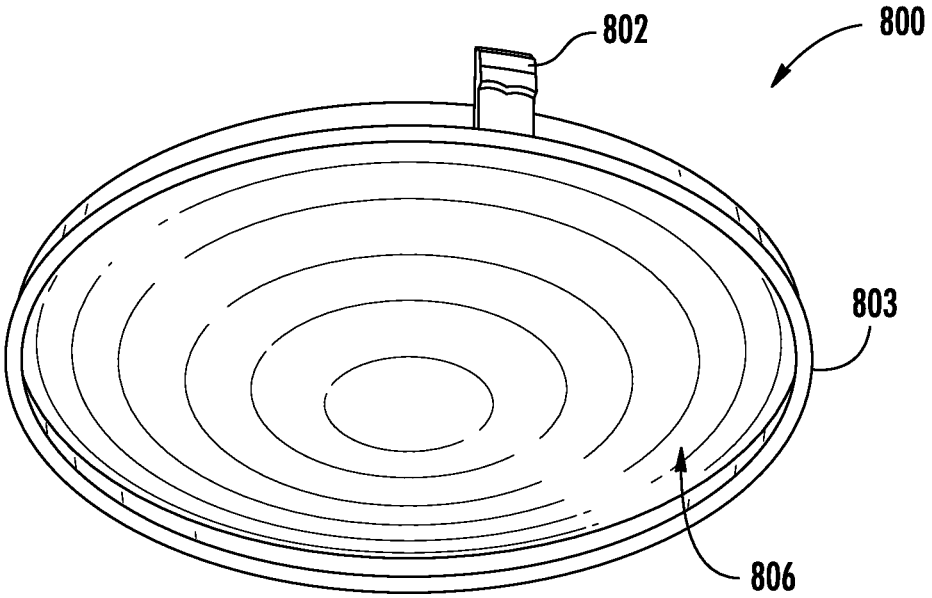
FIGS. 8A and 8B are a perspective view and a cross-sectional side view, respectively, of a lens according to further embodiments of the invention.
Figure 8B:
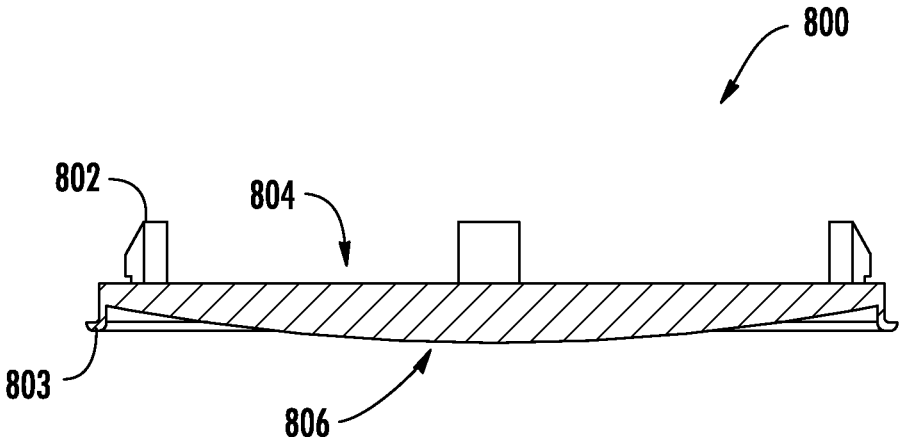
Figure 9:
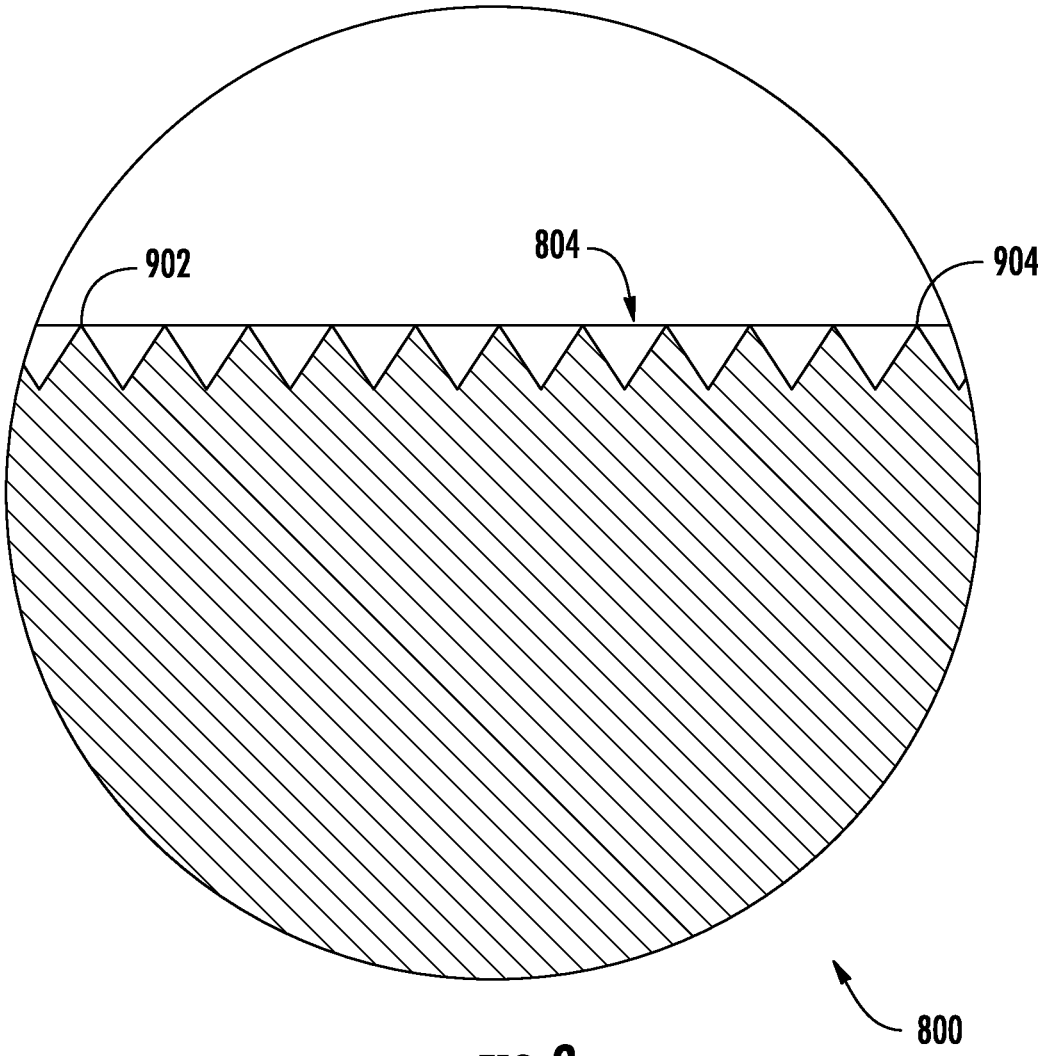
FIG. 9 is a magnified, cross-sectional view of the lens depicted in FIGS. 8A and 8B.

FIGS. 8 and 9 illustrate a detailed example lens according to further example embodiments of the present invention. Lens 800 is presented in FIG. 8 as FIG. 8A, a perspective view and FIG. 8B, a cross-sectional side view. Lens 800 includes a plurality of tabs 802 and a lip 803 for engaging with other parts of a light fixture. Lens 800 is substantially flat its entry surface 804 and curved or convex on its exit surface 806. FIG. 9 shows a close-up, cross-sectional view of a portion of entry surface 804 of lens 800. Substantially triangular concentric rings are visible, again spaced at an interval of 0.500 mm. As can be observed in the figure, a gradient is applied to the vertex angle of the features. Vertex 902 has an angle of 63.0°, and the angle decreases from left to right in the figure until vertex 904 with an angle of 61.0°, in 0.40° increments.

Figure 10A:
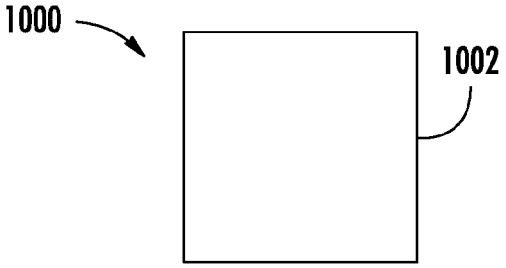
FIG. 10 includes three views of another beam-shaping lens according to example embodiments of the invention. The views in FIG. 10 are designated FIG. 10A, FIG. 10B and FIG. 10C.
Figure 10B:
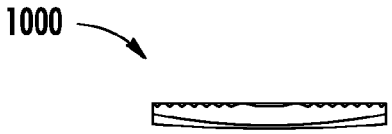
Figure 10C:
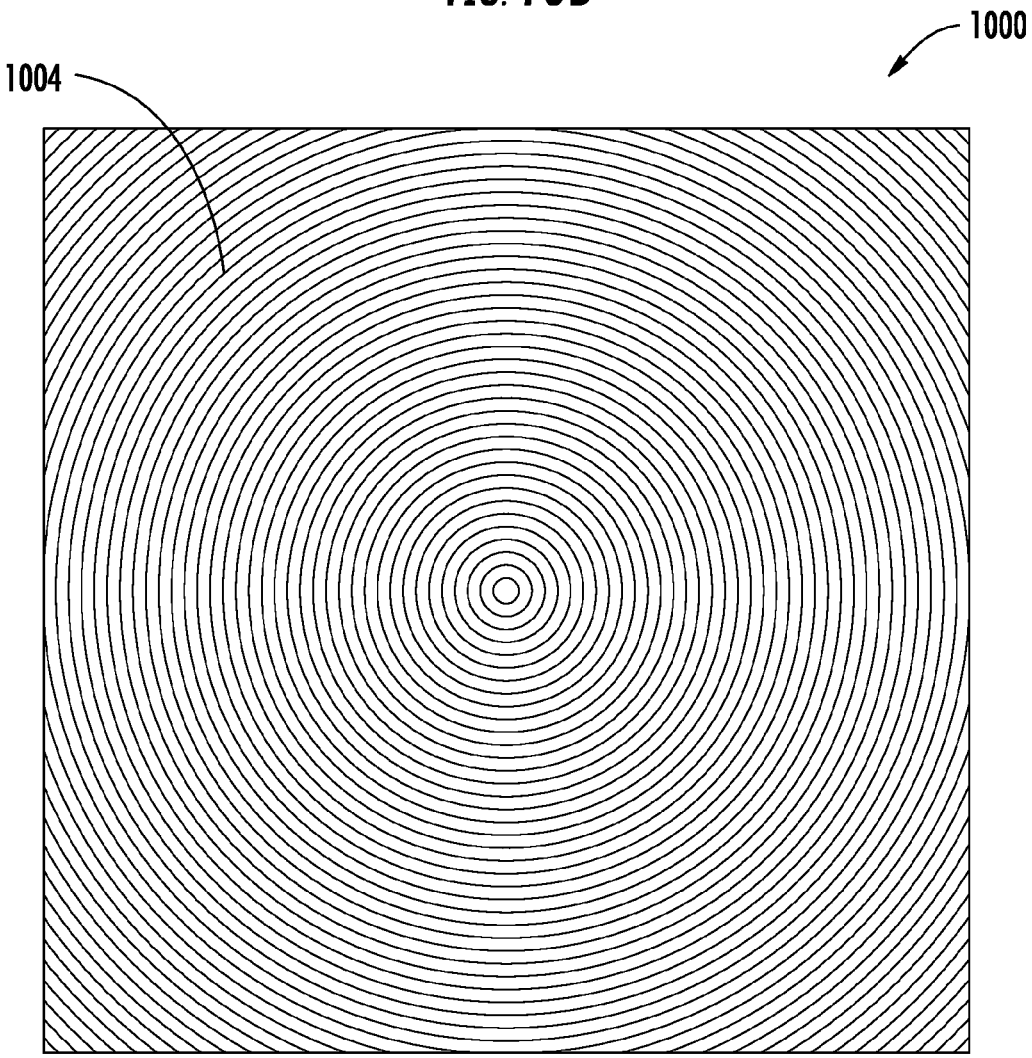

FIG. 10 shows views of a square lens 1000 according to example embodiments of the invention. The view in FIG. 10A is of the exit surface of the lens, in which mainly the square edge 1002 can be seen. The view in FIG. 10B is a side view. The view of FIG. 10C is a magnified view of the entry surface of the lens. Concentric rings 1004 are visible, although they are shown schematically and are not necessarily to scale. As can be readily appreciated in the entry-surface view, the square shape of the lens in this embodiment results in the outermost concentric circles formed by the concentric features in the entry surface of the lens being cut off. However, the lens still functions to allow beam shaping as described, although possibly with somewhat less control at portions of the beam edge. A lens according to example embodiments of the invention can also be made rectangular, and can be used for individual panels in a multi-panel lens system.

A lens according to example embodiments of the invention can be made from various materials, including acrylic, polycarbonate, glass, polyarylate, and many other transparent materials. The textured exit surface of the lens can be created in many ways. For example, a smooth surface could be roughened. The surface could be molded with textured features. Such a surface may be, for example, prismatic in nature. A lens according to embodiments of the invention can also consist of multiple parts co-molded or co-extruded together. For example, the textured surface could be another material co-molded or co-extruded with the portion of the lens with substantially triangular concentric rings. The concentric ring features described herein, whether triangular or otherwise, can be molded into the lens in an injection molding process. Alternatively, the features can be hot-pressed or stamped into the lens during the manufacturing process.

The spacing, angles, and other features of the concentric rings can be varied either across lenses, or within the surface of a single lens in order to achieve various lighting effects. As examples, the vertex angle of the concentric rings can be varied. In some embodiments, the angle is from about 35° to about 90°. In some embodiments, the angle ranges from about 40° to about 65°. The angle can be constant across the radius of the lens, can have a gradient applied, or can vary in other ways, as with some of the examples presented herein. The spacing of the concentric features can similarly vary.

As further specific examples, lenses with the following specifications have been tested and shown to be effective for various beam shaping effects. These first examples all have a ring spacing across the radius of the lens of approximately 3 mm. A lens with vertex angles ranging from 70° to 86°, in one degree increments produces a wide beam. A lens with some vertex angles varying from 65° to 71°, and some angles fixed at 90° with the increment of the former being about 1° produces a flood pattern. A lens with some angles varying in 1° increments between 60° and 71°, some fixed at 71°, and others varying in 1° increments back from 71° to 68° produces a forward pattern. A set of fixed-angle features with a vertex angle of 40° produces a spot pattern of approximately 20° in angular size.

The following examples embodiments that have been tested have a ring spacing across the radius of the lens of approximately 2 mm. A lens with rings having vertex angles varying from 60° to 84° in 1° increments produces a wide pattern. A lens with feature vertex angles varying from 60° to 70° in 1° increments, and additional rings having a fixed angle of approximately 90°, produces a flood pattern. A lens with some vertices varying from 60° to 69° in half-degree increments, four fixed rings with 69° vertices, and two additional rings with 68° and 69° vertices produces a forward pattern. A fixed vertex angle of 40° across the lens again produces a spot pattern of approximately 20° in angular size.

Example embodiments that have been tested with a ring spacing of 1 mm include a lens with a range of vertex angles varying from 70° to 82.25° in 0.25° increments, which produced a wide beam pattern. A lens with 50 rings, 25 with a fixed vertex angle of 90°, and 25 with a varying vertex angle from 60° to 72° in 0.25° increments produced a flood pattern. A lens with some rings varying in 0.50° increments from a vertex angle of 60° to a vertex angle of 73°, and some varying in 0.25° increments from an angle of 73° to angle of 68.25°, and three at a fixed vertex angle of 73°, produced a forward pattern. Finally, a lens with rings having a fixed vertex angle of 40° again produced a spot pattern of approximately 20° in angular size.

In addition to the detailed examples presented herein with a 0.5 mm spacing for the triangular concentric rings across the radius of the lens, the following examples were tested. These include rings with a range of vertex angles from 60° to 80° in 0.2° increments, which produced a wide beam pattern. A lens with 101 rings, 51 of which have vertex angles from 60° to 70° in 0.2° increments, and 50 of which have a fixed vertex angle of 90°, produced a flood pattern. A lens with 101 rings where 19 of them had a fixed vertex angle of 75°, and the remainder were split with vertex angles ranging from 60° to 75° in 0.25° increments and 75° to 70° in 0.25° increments produced a forward pattern.

In addition to the above, it was found that maintaining a constant vertex angle across the radius of the lens but adjusting the angle from lens to lens produced a spot pattern, which varied proportionately in angular size. For example, using features with a vertex angle of 35° produced a 32° spot pattern. Using features with a vertex angle of 45° produced a spot pattern from 10° to 15° in angular size depending on the size of the LED source.

As previously discussed, a lens according to embodiments of the invention in a fixture according to embodiments of the invention can eliminate color separation and pixelization that might otherwise be present with a similar fixture without a lens as described. These aesthetic issues result from using LEDs and possibly phosphor, which emit different colors to produce substantially white light. For example, the example fixtures described herein can include LEDs operable to emit light of two different colors. In such examples, the LED assembly includes an LED or LEDs of a first type which, when illuminated, emit light having dominant wavelength from 440 to 480 nm. The LED assembly may include LEDs of a second type which, when illuminated, emit light having a dominant wavelength from 605 to 630 nm.

In some embodiments some LEDs are packaged with a phosphor. A phosphor is a substance, which, when energized by impinging energy, emits light. In some cases, phosphor is designed to emit light of one wavelength when energized by being struck by light of a different wavelength, and so provides wavelength conversion. In the present example embodiment, one type of LED is packaged with a phosphor which, when excited by light from the included LED, emits light having a dominant wavelength from 560 to 580 nm. In some embodiments of the invention, one type of LED, when illuminated, emits light having a dominant wavelength from 435 to 490 nm, and the other type of LED, when illuminated, emits light having a dominant wavelength from 600 to 640 nm. In some embodiments the phosphor, when excited, emits light having a dominant wavelength from 540 to 585 nm. The phosphor may be packaged with the blue-emitting LED or LEDs to produce blue-shifted yellow (BSY) devices. A further detailed example of using groups of LEDs emitting light of different wavelengths to produce substantially white light can be found in issued U.S. Pat. No. 7,213,940, which is incorporated herein by reference.

The light source for lighting systems that combine light from multiple points, such as multiple LEDs, can be described in terms of the size of the circle that circumscribes all the point light sources. The diameter of this circle can be referred to as the diameter or size of the light source. It can be instructive to compare this size with the size of the aperture of the system. In most cases, this aperture is roughly the size of the lens through which light exits the system. For purposes of this discussion a round lens can be assumed; however, these principles apply to other shapes. Generally, the diameter of the lens for a fixture like those described herein needs to be larger than the size of the light source if the beam is to be directed to fall within a narrow angular range. The narrower the focus desired, the larger the lens needs to be.

Embodiments of the present invention allow for smaller apertures, in comparison to existing systems, to be used with a given size light source to provide the same beam angle. For a given desired beam angle, the ratio of the lens or aperture diameter (LD) to the size of the light source (S) can be at least 60% smaller with embodiments of the present invention than with a similar system using a parabolic reflector or total internal reflection (TIR) optics (a "reflective optical system). In some embodiments, the ratio can be between 20% and 60% smaller. In some embodiments, the ratio can be between about 35% and about 45% smaller. With embodiments of the invention, this ratio, LD/S can be less than 5:1, or between 5:1 and 4:1, while maintaining a spot pattern of from 10° to 15°. In some embodiments, the ratio can be between 8:1 and 4:1, or between 6:1 and 4:1. The ratio for a typical reflective optical system is at least sometimes about 10:1.

A fixture according to some embodiments of the invention can use varied fastening methods and mechanisms for interconnecting the parts of the fixture. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, or other fasteners may be used to fasten together the various components. The lens described with respect to the example embodiments disclosed herein can be fastened in place with thermal epoxy. The lens can be screwed or snap-fit to a fixture, or fastened with separate screws, bolts, rivets or other mechanical fasteners. Other fastening methods can be used to fasten any of the parts of the fixture together, or to attach the lens. A tab and slot or similar mechanical arrangement could be used for multiple parts, as could fasteners such as screws or clips. Tabs can be molded into the lens and used to secure it to the rest of the fixture with corresponding slots. Such tabs are illustrated in FIGS. 4A and 8A herein.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A light engine for a lighting system, the light engine comprising:

an LED light source of size S;

a reflector comprising a bottom portion that is near the LED light source; and a lens attached to the reflector, the lens further comprising, an entry surface including a plurality of concentric rings, each having a substantially triangular cross-section with no side that is parallel to an axis of the lens, wherein the lens has a diameter LD, where the ratio LD/S is between about 8:1 and 4:1; and an exit surface that is textured to provide diffusion.

2. The light engine of claim 1 wherein the concentric rings are spaced at an interval between 0.1 and 5 mm.

3. The light engine of claim 2 wherein the concentric rings are spaced at an interval between 0.2 and 3 mm.

4. The light engine of claim 3 wherein the concentric rings are spaced at an interval between 0.3 and 2 mm.

5. The light engine of claim 4 wherein the exit surface further comprises at least one of roughening and textured features.

6. The light engine of claim 2 wherein each of the concentric rings has a vertex angle of from about 35 degrees to about 90 degrees.

7. The light engine of claim 6 wherein a vertex angle is substantially the same for each of the concentric rings.

8. The light engine of claim 6 wherein a gradient is applied to the vertex angle of the concentric rings so that the vertex angle varies across a radius of the lens.

9. The light engine of claim 8 wherein the exit surface further comprises at least one of roughening and textured features.

10. The light engine of claim 9 wherein the interval of the concentric rings varies across the radius of the lens.

11. The light engine of claim 10 wherein each of the concentric rings has a vertex angle of from about 40 degrees to about 65 degrees.

12. A lighting system comprising:

an LED light source of size S;

a reflector to reflect at least a portion of the light from the LED light source, the reflector including a bottom portion that is near the LED light source; and a lens disposed to receive the light from the LED light source, the lens further including an entry surface comprising a plurality of concentric rings, each having a substantially triangular cross-section with no side that is parallel to an axis of the lens and a textured exit surface to provide diffusion, wherein the lens has a diameter LD, where the ratio LD/S is between about 8:1 and 4:1.

13. The lighting system of claim 12 wherein the concentric rings are spaced at an interval between 0.1 and 5 mm.

14. The lighting system of claim 13 wherein the concentric rings are spaced at an interval between 0.2 and 3 mm.

15. The lighting system of claim 14 wherein the concentric rings are spaced at an interval of about 0.5 mm.

16. The lighting system of claim 13 wherein each of the concentric rings has a vertex angle of from about 35 degrees to about 90 degrees.

17. The lighting system of claim 16 wherein a vertex angle is substantially the same for each of the concentric rings.

18. The lighting system of claim 16 wherein a gradient is applied to the vertex angle of the concentric rings so that the vertex angle varies across a radius of the lens.

19. The lighting system of claim 18 wherein the LED light source further comprises at least first and second LEDs which, when illuminated, emit light having a dominant wavelength from 435 to 490 nm and a dominant wavelength from 600 to 640 nm, respectively, and a phosphor, when excited, emits light having a dominant wavelength from 540 to 585 nm.

20. The lighting system of claim 19 wherein the textured exit surface further comprises at least one of roughening and textured features.

21. The lighting system of claim 20 wherein the interval of the concentric rings varies across the radius of the lens.

22. A method of assembling an LED light fixture, the method comprising:

providing a reflector;

arranging an LED light source of size S proximate to the reflector so that a bottom portion of the reflector is near the LED light source;

connecting the LED light source to a power supply to enable the power supply to energize the LED light source; and attaching a lens to the reflector to receive light from the LED light source at least one of directly or as reflected by the reflector, wherein the lens further comprises an entry surface including a plurality of concentric rings, each having a substantially triangular cross-section with no side that is parallel to an axis of the lens and a textured exit surface to provide diffusion and wherein the lens has a diameter LD, where the ratio LD/S is between about 8:1 and 4:1 and the lens has a beam angle from about 10° to about 15°.

23. The method of claim 22 wherein the concentric rings are spaced at an interval between 0.1 and 5 mm.

24. The method of claim 23 wherein the concentric rings are spaced at an interval between 0.2 and 3 mm.

25. The method of claim 24 wherein the concentric rings are spaced at an interval of about 0.5 mm.

26. The method of claim 25 wherein the textured exit surface further comprises at least one of roughening and textured features.

27. The method of claim 23 wherein each of the concentric rings has a vertex angle of from about 35 degrees to about 90 degrees.

28. The method of claim 27 wherein a gradient is applied to the vertex angle of the concentric rings so that the vertex angle varies across a radius of the lens.

29. The method of claim 28 further comprising assembling the LED light source from at least first and second LEDs which, when illuminated, emit light having a dominant wavelength from 435 to 490 nm and a dominant wavelength from 600 to 640 nm, respectively, and a phosphor, when excited, emits light having a dominant wavelength from 540 to 585 nm.

30. A lighting system comprising:

an LED light source of size S;

a reflector to reflect at least a portion of the light from the LED light source positioned so that a bottom portion of the reflector is near the LED light source; and a lens disposed to receive the light from the LED light source, the lens having a plurality of concentric features on an entry surface, each with non-vertical sides so that an effective surface area of the lens is increased by a surface space of the non-vertical sides and the lens has a diameter LD, where the ratio LD/S is between about 8:1 and 4:1 for a beam angle from about 10° to about 15°.

31. The lighting system of claim 30 wherein the ratio is between about 6:1 and 4:1.

32. The lighting system of claim 30 wherein the ratio is between about 5:1 and 4:1.

* * * * *